US008577257B2

(12) United States Patent
Arai et al.

(10) Patent No.: US 8,577,257 B2
(45) Date of Patent: Nov. 5, 2013

(54) PROCESS UNIT AND IMAGE FORMING APPARATUS INCLUDING SAME

(75) Inventors: Yuji Arai, Kanagawa (JP); Satoshi Hatori, Kanagawa (JP); Toshio Koike, Tokyo (JP); Yuta Azeyanagi, Kanagawa (JP); Kenji Honjoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 242 days.

(21) Appl. No.: 13/087,739

(22) Filed: Apr. 15, 2011

(65) Prior Publication Data

US 2011/0274447 A1 Nov. 10, 2011

(30) Foreign Application Priority Data

May 7, 2010 (JP) ..... 2010-107228
Feb. 23, 2011 (JP) ..... 2011-036966

(51) Int. Cl.
*G03G 21/18* (2006.01)

(52) U.S. Cl.
USPC ..... 399/113; 399/346; 399/360

(58) Field of Classification Search
USPC ..... 399/113, 123, 346, 360
See application file for complete search history.

(56) References Cited

U.S. PATENT DOCUMENTS 4,761,674 A * 8/1988 Ogura ..... 399/35
5,581,342 A * 12/1996 Yamauchi ..... 399/123
6,295,438 B1 * 9/2001 Fujishiro et al. ..... 399/346
6,885,473 B2 * 4/2005 Tsuruya ..... 358/1.18
7,146,122 B2 12/2006 Hatori et al.
7,245,868 B2 7/2007 Arai
7,302,205 B2 11/2007 Shintani et al.
7,366,441 B2 4/2008 Hatori
7,493,061 B2 2/2009 Hatori et al.
7,546,064 B2 6/2009 Yoshino et al.
2006/0002736 A1 * 1/2006 Kikuchi et al. ..... 399/111
2006/0039710 A1 * 2/2006 Tawada ..... 399/35

(Continued)

FOREIGN PATENT DOCUMENTS

JP 3503861 12/2003
JP 2004-184820 7/2004

(Continued)

OTHER PUBLICATIONS

Federal Plain Language Guidelines: "Avoid legal, foreign, and technical jargon" http://www.plainlanguage.gov/howto/guidelines/FederalPLGuidelines/writeNoJargon.cfm.*

*Primary Examiner* — Walter L Lindsay, Jr.
*Assistant Examiner* — Benjamin Schmitt
(74) *Attorney, Agent, or Firm* — Oblon, Spivak, McClelland, Maier & Neustadt, L.L.P.

(57) ABSTRACT

A process unit including a first housing detachably attachable to an image forming apparatus, an image carrier to carry an image on a surface of the image carrier, a charger to charge the surface of the image carrier, a developing device to form the image on the surface of the image carrier, a cleaning device to remove toner from the surface of the image carrier, a lubricant to be supplied to the surface of the image carrier, a lubricant container to contain the lubricant, and a waste toner container to store the toner removed from the surface of the image carrier. The first housing includes the image carrier and at least one of the charger, the developing device, and the cleaning device. The lubricant, the lubricant container, and the waste toner container together are detachably attachable to the first housing.

19 Claims, 16 Drawing Sheets

(56) References Cited

U.S. PATENT DOCUMENTS

| | | | | |
|---|---|---|---|---|
| 2009/0003858 | A1* | 1/2009 | Nishida | 399/48 |
| 2009/0097879 | A1 | 4/2009 | Nagashima et al. | |
| 2010/0034557 | A1 | 2/2010 | Arai et al. | |
| 2010/0080600 | A1 | 4/2010 | Okamoto et al. | |

FOREIGN PATENT DOCUMENTS

| | | |
|---|---|---|
| JP | 2005-25162 | 1/2005 |
| JP | 2006-11360 | 1/2006 |
| JP | 2010-26272 A | 2/2010 |
| JP | 4627176 | 11/2010 |

* cited by examiner

PROCESS UNIT AND IMAGE FORMING APPARATUS INCLUDING SAME

CROSS-REFERENCE TO RELATED APPLICATIONS

The present patent application is based on and claims priority pursuant to 35 U.S.C. §119 from Japanese Patent Application Nos. 2010-107228, filed on May 7, 2010, and 2011-036966, filed on Feb. 23, 2011, both in the Japan Patent Office, each of which is incorporated herein by reference in its entirety.

BACKGROUND OF THE INVENTION

1. Field of the Invention

Exemplary aspects of the present invention generally relate to a process unit and an image forming apparatus including the process unit.

2. Description of the Background

Related-art image forming apparatuses, such as copiers, printers, facsimile machines, and multifunction devices having two or more of copying, printing, and facsimile functions, typically form a toner image on a recording medium (e.g., a sheet of paper, etc.) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; a cleaning device removes residual toner from the surface of the photoconductor, and a fixing device applies heat and pressure to the sheet bearing the toner image to fix the toner image onto the sheet. The sheet bearing the fixed toner image is then discharged from the image forming apparatus.

There is known a process unit including the photoconductor and at least one of the charger, the developing device, the cleaning device, and so forth. The process unit is detachably attachable to the image forming apparatus, and can be replaced with a new process unit upon repair or at the end of the product life thereof so that the image forming apparatus itself can be continuously used thereafter. Thus, the image forming apparatus can be returned to service merely by replacing the process unit with the new process unit, thereby improving work efficiency. Further, on occasion even a user may easily replace the process unit with the new process unit.

The image forming apparatus employing the process unit is generally provided with a waste toner container that stores waste toner, that is, the residual toner removed from the photoconductor by the cleaning device after image formation is completed. A cycle of replacement of the waste toner container filled up with the waste toner is generally shorter than the product lives of the other components such as the photoconductor and the developing device. Therefore, only the waste toner container is replaced with a new waste toner container, and the process unit itself is continuously used thereafter without replacement until the end of the product life thereof.

In addition, the process unit is often provided with a lubricant supplier that supplies a lubricant to the surface of the photoconductor in order to more effectively clean the surface of the photoconductor, thereby preventing white spots in a resultant image caused by incomplete transfer of the toner image onto the sheet. However, in a case in which the process unit is provided integrally with the lubricant, the process unit as a whole needs to be replaced with the new process unit upon exhaustion of the lubricant even when the other components such as the photoconductor, the charger, and the developing device are still serviceable, resulting in a cost increase and a waste of resources. In order to use the process unit until the actual end of its product life, a process unit having a configuration in which the lubricant alone is replaceable has been proposed.

In recent years, compact image forming apparatuses often include a waste toner container to which waste toner is directly discharged from a process unit, thereby reducing a size, number of components, and production costs of the image forming apparatus. In such image forming apparatuses, the process unit and the waste toner container are provided close to each other, to limit a size of the waste toner container and shorten a cycle of replacement of the waste toner container. As a result, the cycle of replacement of the waste toner container may approach the cycle of replacement of the lubricant. However, the waste toner container and the lubricant are individually replaced with a new waste toner container and a new lubricant at separate times. Consequently, work efficiency is degraded when replacement of the waste toner container and the lubricant are needed one after another.

SUMMARY

In view of the foregoing, illustrative embodiments of the present invention provide a novel process unit in which a lubricant and a waste toner container are efficiently replaced with a new lubricant and a new waste toner container while other components such as a photoconductor can be effectively used until the end of their product lives. Illustrative embodiments of the present invention also provide a novel image forming apparatus including the process unit described above.

In one illustrative embodiment, a process unit includes a first housing detachably attachable to an image forming apparatus, an image carrier to carry an image on a surface thereof, a charger to charge the surface of the image carrier, a developing device to form the image on the surface of the image carrier, a cleaning device to remove toner from the surface of the image carrier, a lubricant to be supplied to the surface of the image carrier, a lubricant container to contain the lubricant, and a waste toner container to store the toner removed from the surface of the image carrier. The first housing includes the image carrier and at least one of the charger, the developing device, and the cleaning device. The lubricant, the lubricant container, and the waste toner container together are detachably attachable to the first housing.

Another illustrative embodiment provides an image forming apparatus including the process unit described above.

Additional features and advantages of the present disclosure will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
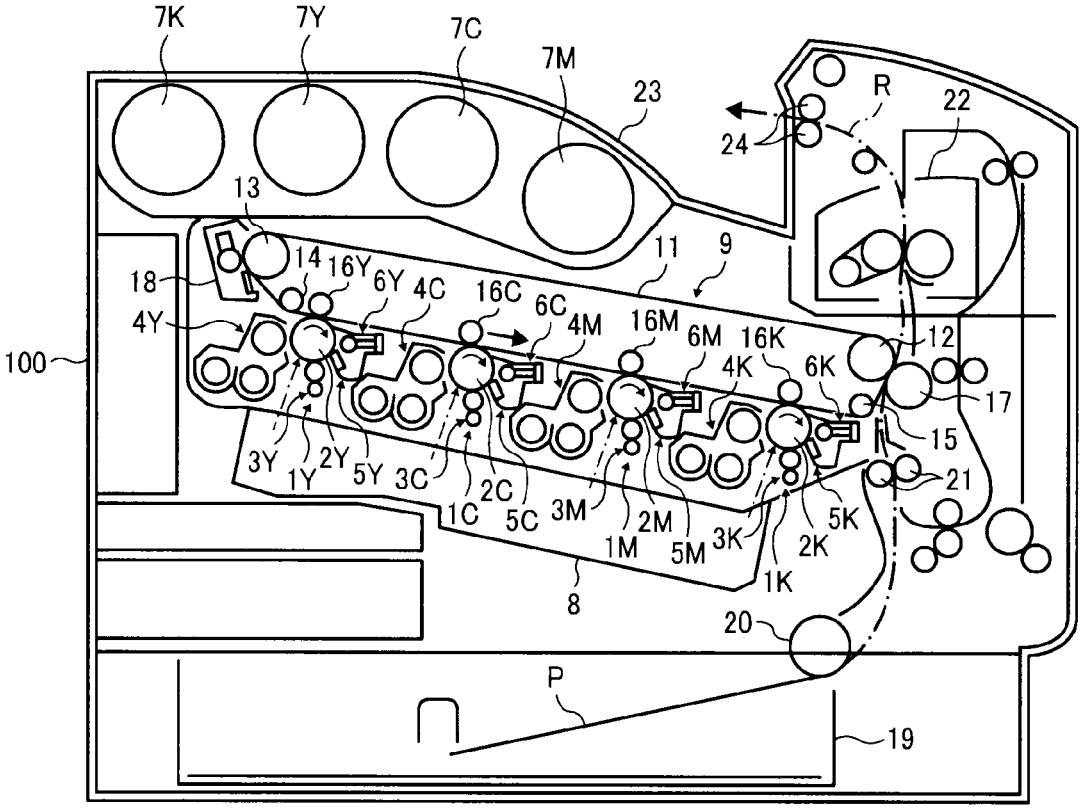
FIG. 1 is a vertical cross-sectional view illustrating an example of a configuration of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A description is now given of a configuration and operations of an image forming apparatus 100 according to illustrative embodiments with reference to FIG. 1. FIG. 1 is a vertical cross-sectional view illustrating an example of a configuration of the image forming apparatus 100 according to illustrative embodiments.

Figure 2:
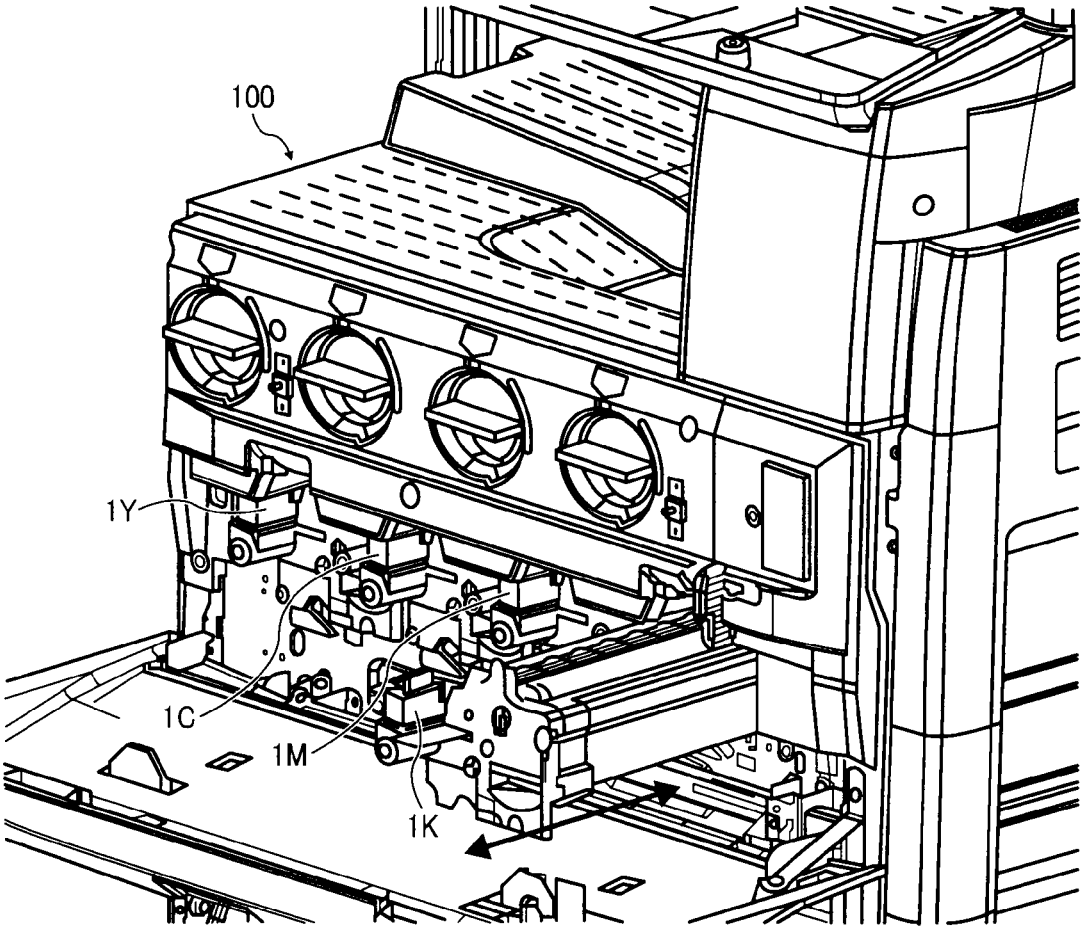
FIG. 2 is a perspective view illustrating attachment and detachment of a process unit to and from the image forming apparatus illustrated in FIG. 1.

The image forming apparatus 100 includes four process units 1Y, 1C, 1M, and 1K (hereinafter collectively referred to as process units 1) each serving as an image forming unit detachably attachable to the image forming apparatus 100. Each of the four process units 1 has the same basic configuration, differing only in the color of toner used, that is, yellow (Y), cyan (C), magenta (M), or black (K), each corresponding to color separation components of full-color images. The process units 1 respectively include photoconductors 2Y, 2C, 2M, and 2K (hereinafter collectively referred to as photoconductors 2) each serving as an image carrier; chargers 3Y, 3C, 3M, and 3K (hereinafter collectively referred to as chargers 3) that charge surfaces of the photoconductors 2, respectively; developing devices 4Y, 4C, 4M, and 4K (hereinafter collectively referred to as developing devices 4) that form toner images of the respective colors on the charged surfaces of the photoconductors 2, respectively; cleaning devices 5Y, 5C, 5M, and 5K (hereinafter collectively referred to as cleaning devices 5) that remove residual toner from the surfaces of the photoconductors 2; and lubricant applicators 6Y, 6C, 6M, and 6K (hereinafter collectively referred to as lubricant applicators 6) that apply a lubricant to the surfaces of the photoconductors 2. Each of the process units 1 is detachably attachable to the image forming apparatus 100 by inserting or pulling the process units 1 into or out from the image forming apparatus 100 in a longitudinal direction of each of the process units 1 as illustrated in FIG. 2. FIG. 2 is a perspective view illustrating attachment and detachment of the process units 1 to and from the image forming apparatus 1.

Toner bottles 7Y, 7C, 7M, and 7K (hereinafter collectively referred to as toner bottles 7) that store toner of the respective colors are provided at an upper portion of the image forming apparatus 100. The toner stored in the toner bottles 7 is supplied to the respective developing devices 5 through toner transport tubes, not shown. An irradiating device 8 that irradiates the surfaces of the photoconductors 2 with laser light is provided below the process units 1. A transfer device 9 including an intermediate transfer belt 11 is provided between the toner bottles 7 and the process units 1. The intermediate transfer belt 11 is composed of a seamless belt serving as a transferred body, and is wound around multiple support rollers 12, 13, 14, and 15. One of the support rollers 12, 13, 14, and 15 serves as a drive roller, and rotation of the drive roller rotates the intermediate transfer belt 11 in a counterclockwise direction in FIG. 1.

Four primary transfer rollers 16Y, 16C, 16M, and 16K (hereinafter collectively referred to as primary transfer rollers 16) each serving as a primary transfer unit are provided opposite the four photoconductors 2, respectively, with the intermediate transfer belt 11 interposed therebetween, and primary transfer nips are formed between the primary transfer rollers 16 and the photoconductors 2, respectively. A secondary transfer roller 17 serving as a secondary transfer unit is provided on the right of the intermediate transfer belt 11 in FIG. 1 to contact an outer circumferential surface of the intermediate transfer belt 11. Specifically, the secondary transfer roller 17 is provided opposite the support roller 12 with the intermediate transfer belt 11 interposed therebetween, and a secondary transfer nip is formed between the secondary transfer roller 17 and the support roller 12. A belt cleaning device 18 that cleans a surface of the intermediate transfer belt 11 is provided on the left of the intermediate transfer belt 11 in FIG. 1 to contact the outer circumferential surface of the intermediate transfer belt 11.

A sheet feed tray 19 that stores sheets P each serving as a recording medium, a sheet feed roller 20 that conveys the sheets P one by one from the sheet feed tray 19, and so forth are provided at a lower portion of the image forming apparatus 100. A conveyance path R that guides the sheet P upward from the sheet feed tray 19 is formed within the image forming apparatus 100. A pair of registration rollers 21 that determines a timing to convey the sheet P to the secondary transfer nip is provided within the conveyance path R between the sheet feed roller 20 and the secondary transfer roller 17. The image forming apparatus 100 further includes a fixing device 22 provided above the secondary transfer roller 17 to fix a toner image onto the sheet P. A pair of discharge rollers 24 that discharge the sheet P to a discharge stock 23 is provided above the fixing device 22. The discharge stock 23 is formed at a recessed portion on an upper surface of the image forming apparatus 100.

Upon startup of image formation, the photoconductors 2 are rotatively driven by a drive unit, not shown, in a clockwise direction in FIG. 1, and the surfaces of the photoconductors 2 are evenly charged to a predetermined polarity by the chargers 3, respectively. The irradiating device 8 irradiates each of the charged surfaces of the photoconductors 2 with laser light based on image data of the specified color, that is, yellow (Y), cyan (C), magenta (M), or black (K) obtained by color separation of a full-color image to be formed. Accordingly, electrostatic latent images of the specified colors are formed on the surfaces of the photoconductors 2, respectively. Then, the developing devices 4 supply toner of the respective colors to the electrostatic latent images formed on the surfaces of the photoconductors 2 to form toner images on the surfaces of the photoconductors 2, respectively.

In the meantime, the drive roller, that is, one of the support rollers 12, 13, 14, and 15 around with the intermediate transfer belt 11 is wound, is rotatively driven to rotate the intermediate transfer belt 11 in the counterclockwise direction in FIG. 1. A constant current or a voltage under constant current control each having a polarity opposite a polarity of charged toner of the toner images is applied to the primary transfer rollers 16. Accordingly, transfer magnetic fields are formed at the primary transfer nips, respectively. The toner images of the respective colors formed on the photoconductors 2 are sequentially transferred onto the intermediate transfer belt 11 at the primary transfer nips by the transfer magnetic fields and are superimposed one atop the other on the intermediate transfer belt 11. As a result, a full-color toner image is formed on the intermediate transfer belt 11. After primary transfer of the toner images from the photoconductors 2 onto the intermediate transfer belt 11, a lubricant 60 described in detail later is applied to the surfaces of the photoconductors 2 by the lubricant applicators 6, and then the cleaning devices 5 remove residual toner from the surfaces of the photoconductors 2, respectively.

Meanwhile, upon startup of image formation, the sheet feed roller 20 is rotated so that the sheet P is fed from the sheet feed tray 19 to the conveyance path R. Conveyance of the sheet P fed to the conveyance path R is temporarily stopped by the pair of registration rollers 21. Thereafter, driving of the pair of registration rollers 21 is resumed to convey the sheet P to the secondary transfer nip in synchronization with the full-color toner image formed on the intermediate transfer belt 11. At this time, a transfer voltage having a polarity opposite a polarity of toner of the full-color toner image is applied to the secondary transfer roller 17 so that a transfer magnetic field is formed at the secondary transfer nip. When the sheet P and the full-color toner image formed on the intermediate transfer belt 11 reach the secondary transfer nip, the full-color toner image is secondarily transferred onto the sheet P by the transfer magnetic field formed at the secondary transfer nip. After secondary transfer of the full-color toner image from the intermediate transfer belt 11 onto the sheet P, the belt cleaning device 18 removes residual toner from the intermediate transfer belt 11. The sheet P having the transferred full-color toner image thereon is then conveyed to the fixing device 22 so that the full-color toner image is fixed to the sheet P. Thereafter, the sheet P having the fixed full-color image thereon is discharged to the discharge stock 23 by the pair of discharge rollers 24.

Although the full-color image is formed in the above-described example, a monochrome image may be formed by the image forming apparatus 100 using only one of the four process units 1. Alternatively, a bicolor or tricolor image may be formed by using two or three of the process units 1.

Figure 3:
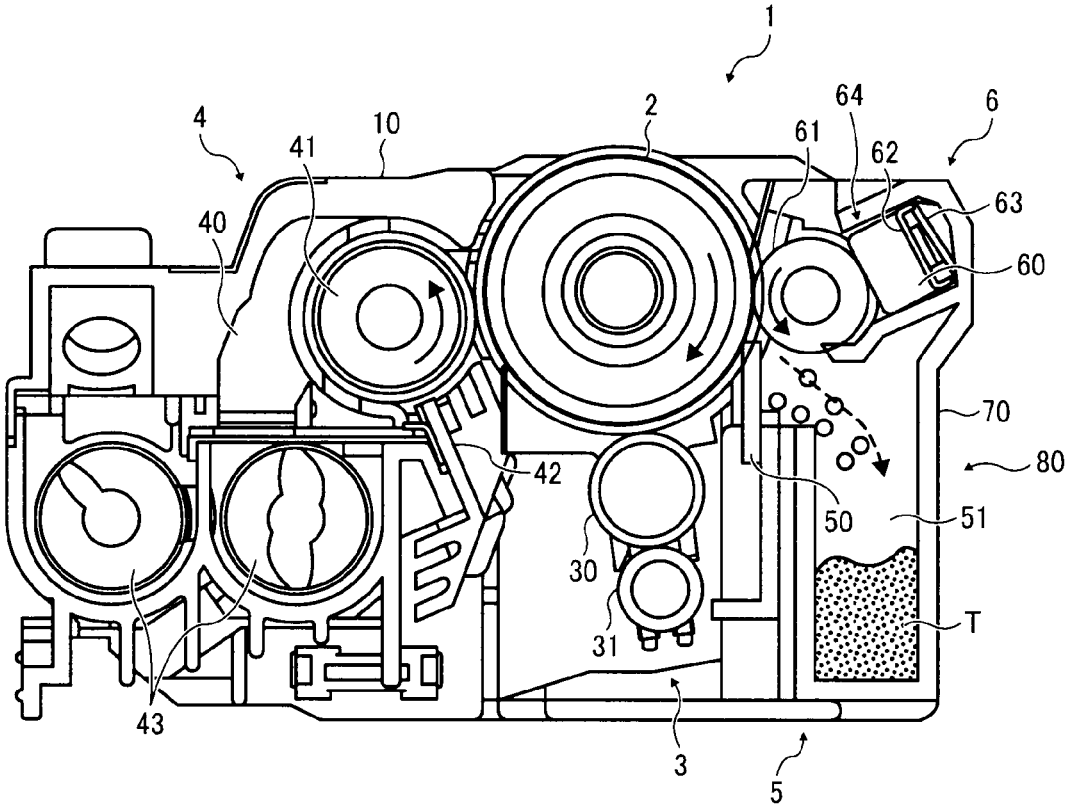
FIG. 3 is a vertical cross-sectional view illustrating an example of a configuration of the process unit.

A description is now given of a configuration of each component provided to the process units 1 with reference to FIG. 3. FIG. 3 is vertical cross-sectional view illustrating an example of a configuration of the process units 1 according to illustrative embodiments. It is to be noted that, because each of the four process units 1 has the same basic configuration as described above, FIG. 3 and the rest of the drawings show the configuration of only one of the process units 1 in the image forming apparatus 1, and the suffixes that indicate the colors of toner, that is, Y, C, M, and K, are omitted.

As illustrated in FIG. 3, the charger 3 includes a charging roller 30 serving as a charging member provided opposite the photoconductor 2, and a cleaning roller 31 provided in contact with a surface of the charging roller 30 at a position opposite a position where the charging roller 30 faces the photoconductor 2.

The developing device 4 includes a developer container 40 that stores a developer, a developing roller 41 provided opposite the photoconductor 2, a developing blade 42 that controls an amount of the developer on the developing roller 41, and conveyance screws 43 that convey the developer from the developer container 40 to the developing roller 41. It is to be noted that, although a two-component developer including toner and carrier is used as the developer according to illustrative embodiments, a type of the developer is not limited thereto.

The cleaning device 5 includes a cleaning blade 50 that removes the residual toner from the surface of the photoconductor 2, and a waste toner container 51 that stores the residual toner removed from the surface of the photoconductor 2 by the cleaning blade 50. A tip of the cleaning blade 50 contacts the surface of the photoconductor 2 with a predetermined pressing force.

The lubricant applicator 6 includes a solid lubricant 60, a lubricant application roller 61 serving as a lubricant supplier, a lubricant holder 62 that holds the lubricant 60, a biasing spring 63 serving as a pressing member that presses the lubricant 60 against the lubricant application roller 61, and a lubricant container 64 that stores the lubricant 60. The lubricant application roller 61 contacts the surface of the photoconductor 2 and is rotated as the photoconductor 2 rotates. It is preferable that a brush roller, a sponge roller, or the like be used as the lubricant application roller 61. Although the biasing spring 63 is used to press the lubricant 60 against the lubricant application roller 61 in the above-described example, alternatively, a spindle may be provided to the lubricant 60 such that the weight of the spindle contacts the lubricant 60 against the lubricant application roller 61. Further alternatively, the lubricant 60 may contact the lubricant application roller 61 by the gravity of the lubricant 60 itself. The lubricant 60 is fixed to the lubricant holder 62 with a double-sided tape, an adhesive, or the like.

Although the lubricant 60 may include fatty acid metal salt, a fluorine resin, or the like, fluorine resin is the most preferable due to its effectiveness in reducing friction on the photoconductor 2. Examples of fatty acid metal salt include, but are not limited to, straight-chain hydrocarbons such as myristic acid, palmitic acid, stearic acid, and oleic acid. Examples of metals include, but are not limited to, lithium, magnesium, calcium, strontium, zinc, cadmium, aluminum, cerium, titanium, magnesium stearate, aluminum stearate, iron stearate, and zinc stearate. Of these, zinc stearate is the most preferable.

A description is now given of operation of each of the process units 1, again with reference to FIG. 3.

Upon startup of image formation, the photoconductor 2 is rotatively driven in a clockwise direction in FIG. 3. At this time, the surface of the photoconductor 2 is charged to a predetermined polarity by the charging roller 30 to which a charging voltage is applied. The charging roller 30 is cleaned by the cleaning roller 31 after charging the surface of the photoconductor 2. The irradiating device 8 directs the laser light onto the charged surface of the photoconductor 2 to form an electrostatic latent image on the surface of the photoconductor 2 in accordance with input image data. Thereafter, toner is supplied to the electrostatic latent image from the developing roller 41 when the electrostatic latent image formed on the surface of the photoconductor 2 is moved to a position opposite the developing roller 41. Specifically, the developer carried by the developing roller 41 rotated in a counterclockwise direction in FIG. 3 is controlled by the developing blade 42 to have a predetermined thickness. Then, the developer having the predetermined thickness is conveyed to a developing range formed between the developing roller 41 and the photoconductor 2 where toner of the developer is electrostatically moved to the electrostatic latent image formed on the surface of the photoconductor 2 so that the electrostatic latent image is rendered visible by the toner as a toner image. The toner image formed on the surface of the photoconductor 2 is conveyed to an upper portion of the photoconductor 2 to be primarily transferred onto the intermediate transfer belt 11, which is not shown in FIG. 3.

After the toner image is primarily transferred onto the intermediate transfer belt 11, the lubricant 60 is applied to the surface of the photoconductor 2 by the lubricant application roller 61 rotated in the counterclockwise direction in FIG. 3. Thereafter, residual toner on the surface of the photoconductor 2 is removed by the cleaning blade 50 and is stored in the waste toner container 51. It is to be noted that the residual toner stored in the waste toner container 51 is hereinafter referred to as waste toner T.

As shown in FIG. 3, the process unit 1 has a unit housing 10 serving as a first housing detachably attachable to the image forming apparatus 100. Although the photoconductor 2, the charger 3, the developing device 4, and so forth are formed together as a single integrated unit within the unit housing 10, the lubricant 60, the waste toner container 51, and so forth are not provided within the unit housing 10. Instead, the lubricant 60, the lubricant holder 62, the biasing spring 63, the lubricant container 64, and the waste toner container 51 are provided within a sub-unit housing 70 of a sub-unit 80. The housing 70 serving as a second housing is formed independently from the unit housing 10 as a separate member, and is detachably attachable to the unit housing 10. Among the components of the lubricant applicator 6, the lubricant application roller 61 is provided to the unit housing 10.

Figure 4A:
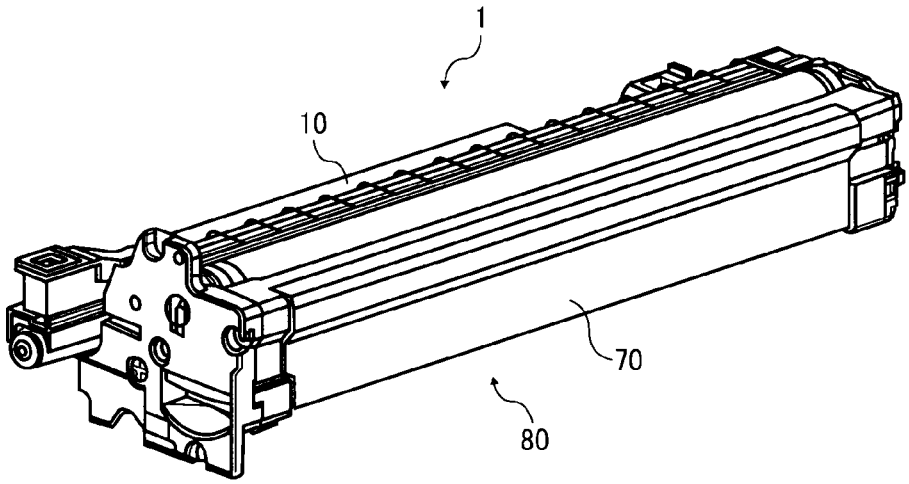
FIGS. 4A and 4B are perspective views respectively illustrating an example of attachment and detachment of a sub-unit to and from a unit housing.
Figure 4B:
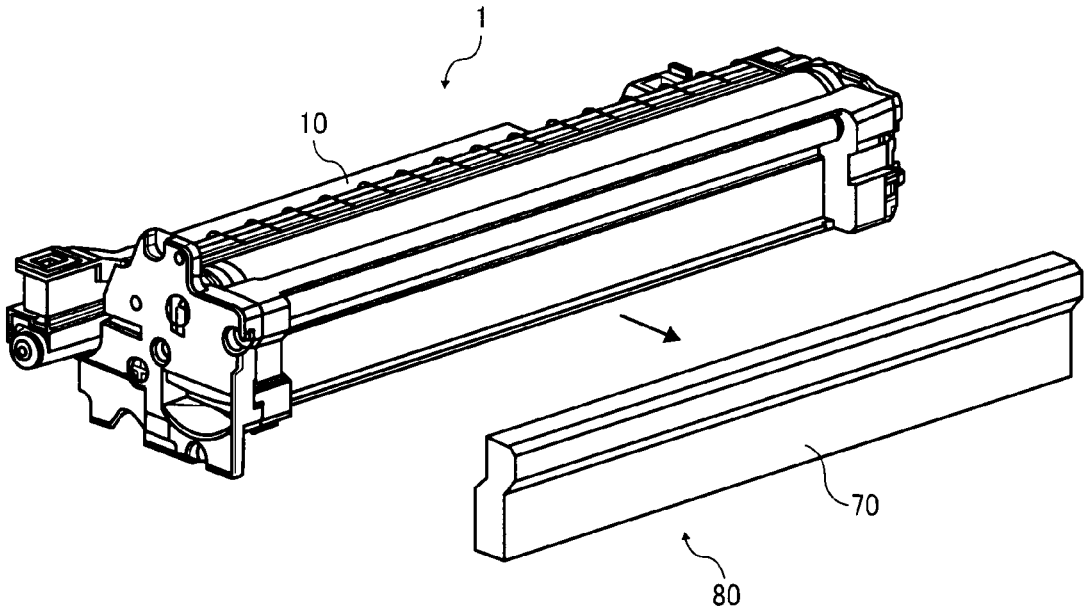

The lubricant 60, the lubricant holder 62, the biasing spring 63, and the waste toner container 51 are formed together as a single integrated unit to form the sub-unit 80 detachably attachable to the unit housing 10. FIGS. 4A and 4B are perspective views respectively illustrating an example of attachment and detachment of the sub-unit 80 to and from the unit housing 10.

Figure 5A:
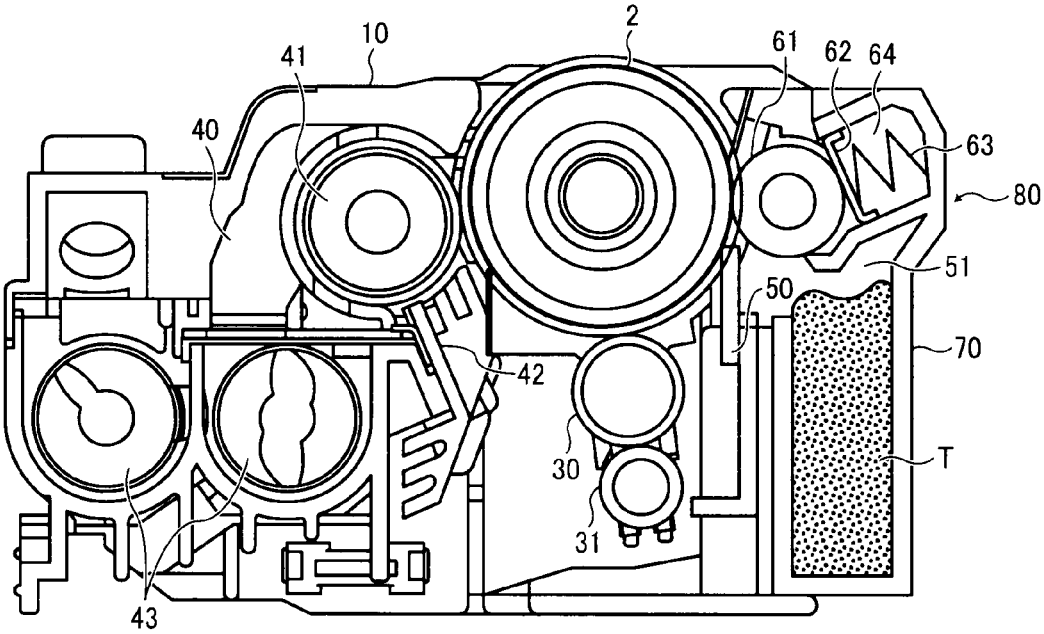
FIGS. 5A, 5B, and 5C are vertical cross-sectional views illustrating replacement of the sub-unit.
Figure 5B:
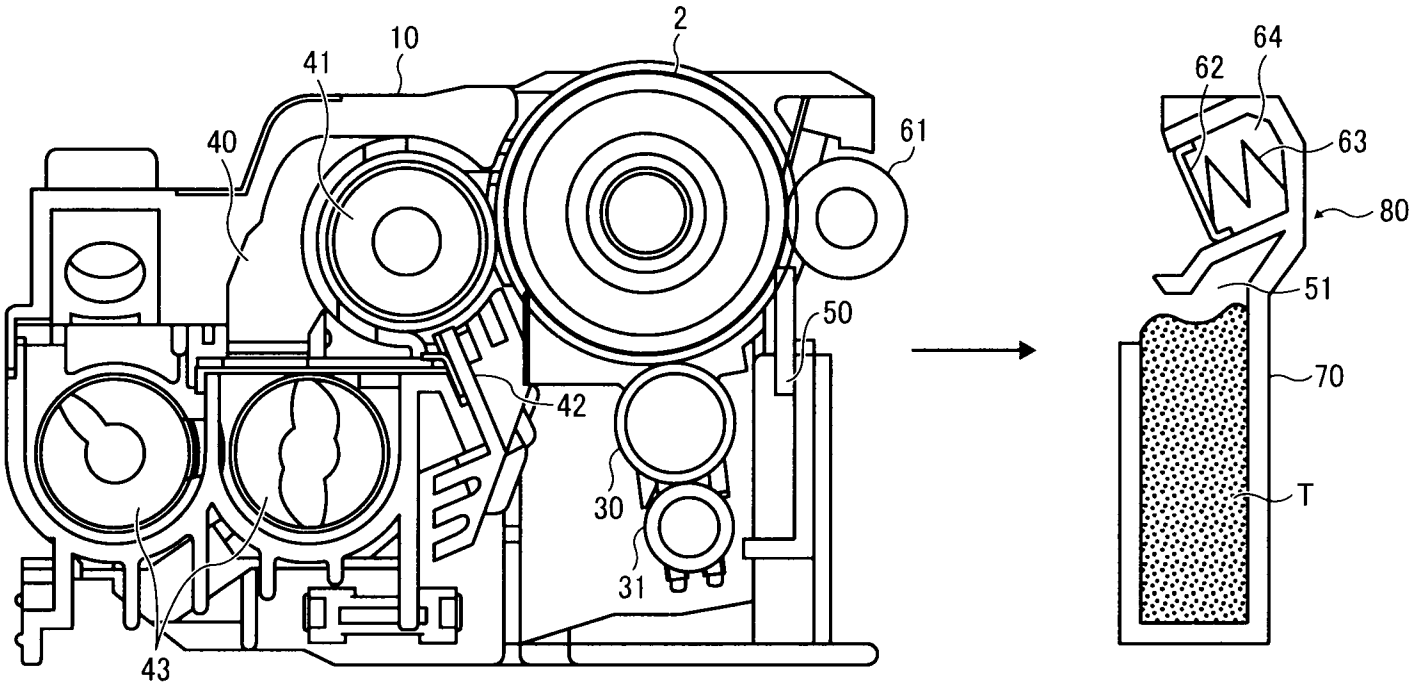
Figure 5C:
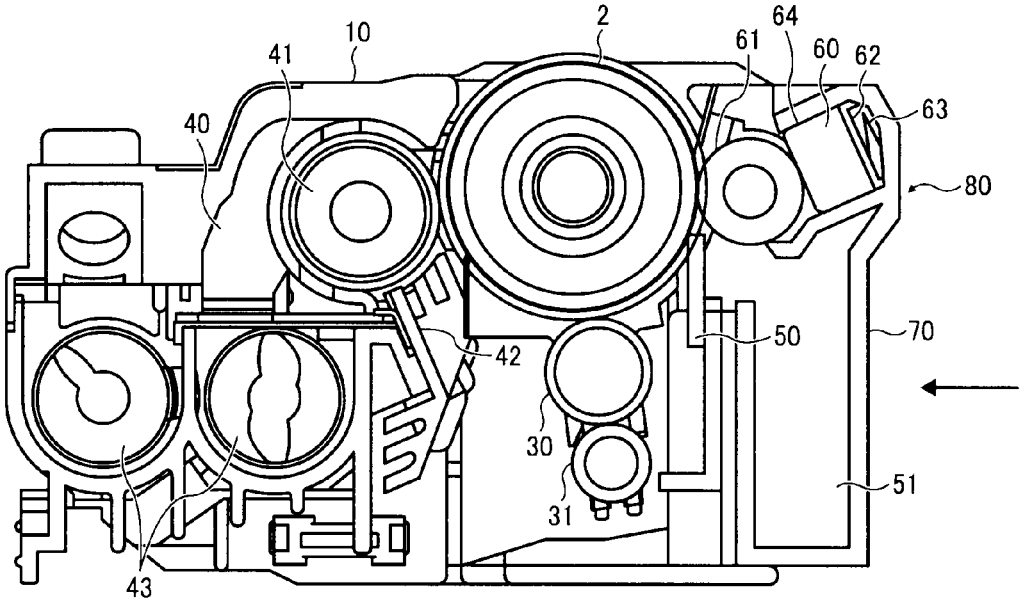

As described above, the lubricant 60, the waste toner container 51, and so forth are provided within the sub-unit 80 detachably attachable to the unit housing 10. As a result, when the lubricant 60 is used up and the waste toner container 51 is filled up with the waste toner T as illustrated in FIG. 5A, the sub-unit 80 is detached from the unit housing 10 as illustrated in FIG. 5B to replace the sub-unit 80 with a new sub-unit 80 having a new lubricant 60 and a new waste toner container 51 as illustrated in FIG. 5C. Accordingly, replacement of the lubricant 60 and the waste toner container 51 is performed simultaneously.

In the above-described example, a direction in which the sub-unit 80 is attached to or detached from the unit housing 10 is perpendicular to a direction in which the process unit 1 is attached to and detached from the image forming apparatus 100. As a result, the process unit 1 must be detached from the image forming apparatus 100 before replacement of the sub-unit 80.

Figure 6A:
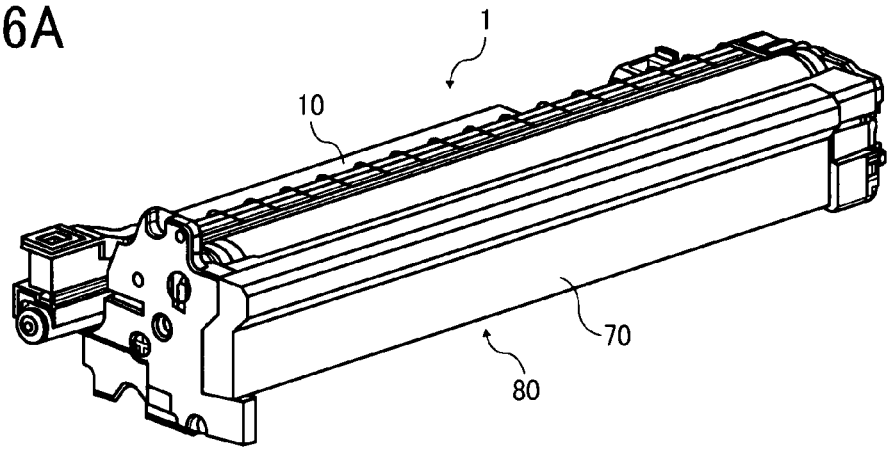
FIGS. 6A, 6B, and 6C are perspective views respectively illustrating another example of attachment and detachment of the sub-unit to and from the unit housing.
Figure 6B:
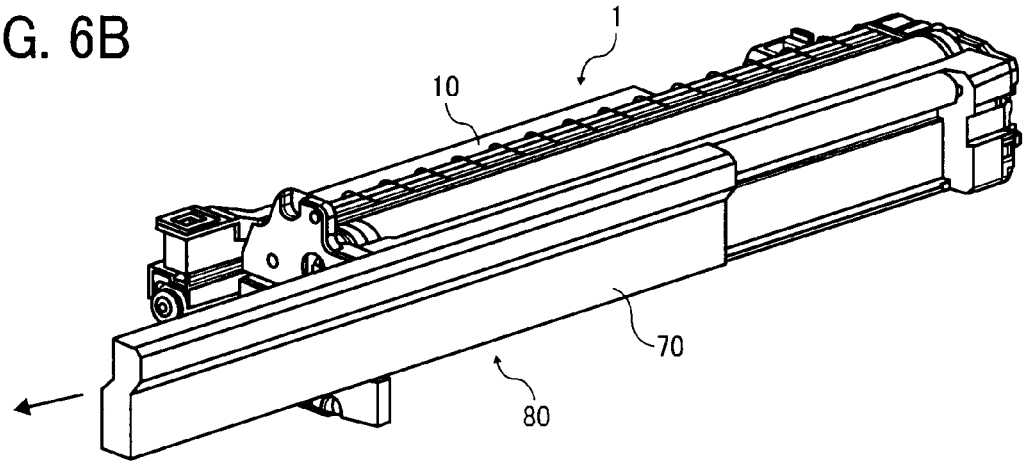
Figure 6C:
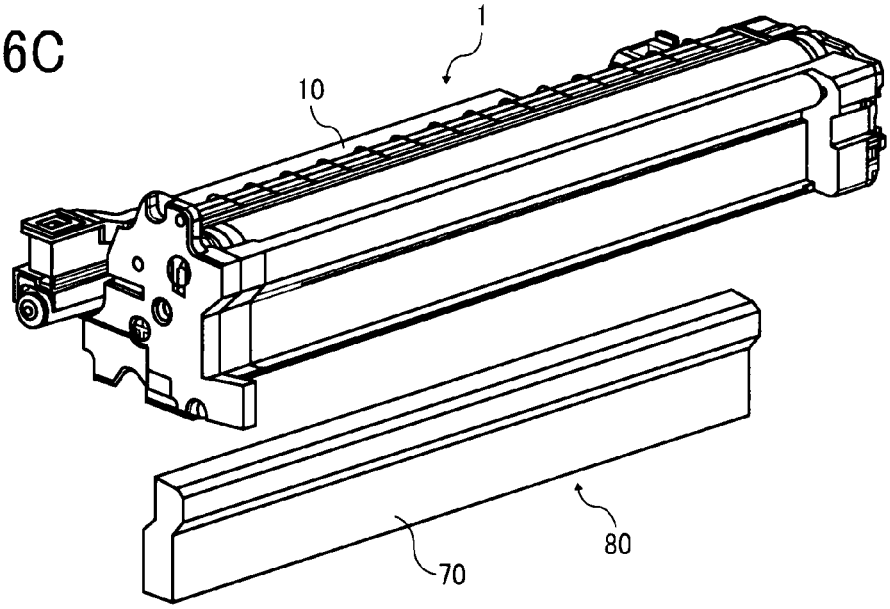

To facilitate replacement of the sub-unit 80, as illustrated in FIGS. 6A to 6C the direction in which the sub-unit 80 is attached to or detached from the unit housing 10 may be set to be the same as the direction in which the process unit 1 is attached to and detached from the image forming apparatus 100. Accordingly, the sub-unit 80 can be attached to and detached from the unit housing 10 without detachment of the process unit 1 from the image forming apparatus 100, thereby facilitating and streamlining replacement of the sub-unit 80.

Figure 7A:
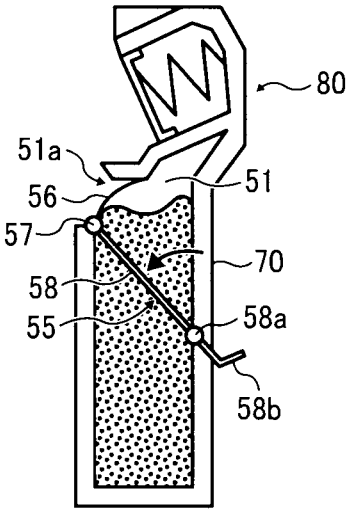
FIGS. 7A and 7B are vertical cross-sectional views respectively illustrating an example of a configuration of the sub-unit.
Figure 7B:
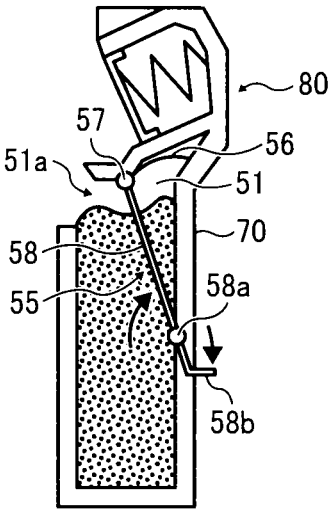
Figure 8:
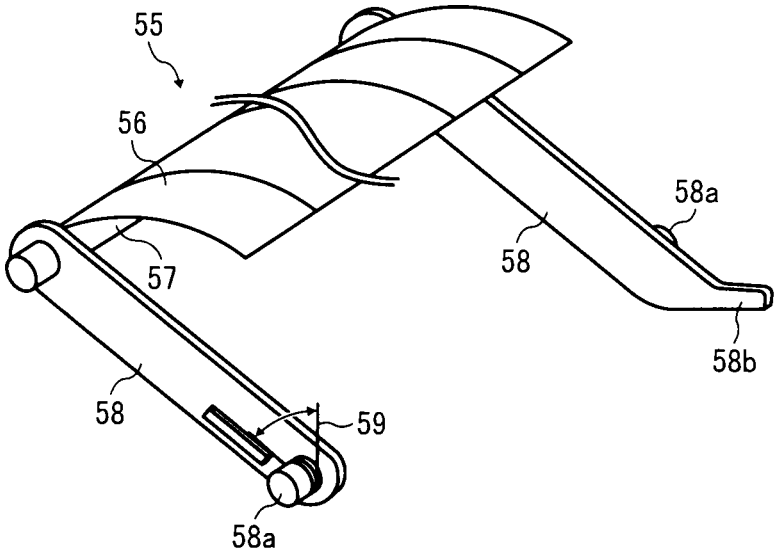
FIG. 8 is a perspective view illustrating an example of a configuration of a shutter assembly included in the sub-unit illustrated in FIGS. 7A and 7B.

FIGS. 7A and 7B are vertical cross-sectional views respectively illustrating an example of a configuration of the sub-unit 80 having a shutter assembly 55. FIG. 8 is a perspective view illustrating an example of a configuration of the shutter assembly 55 illustrated in FIGS. 7A and 7B.

The shutter assembly 55 includes a shutter 56, a shutter holder 57 in the shape of a rod or shaft that holds the shutter 56, and a pair of rotary arms 58 that supports the shutter holder 57. The shutter 56 is formed of a rectangular sheet member, and an edge of the shutter 56 extending in a longitudinal direction thereof is mounted on the shutter holder 57. One end of each of the pair of rotary arms 58 is mounted on a respective end of the shutter holder 57, and the other end of each of the pair of rotary arms 58 is provided with a pivot 58*a*, respectively. The pair of rotary arms 58 is rotatably mounted on the housing 70 of the sub-unit 80 around the pivots 58*a*. The shutter 56 opens and closes an entrance 51*a* of the waste toner container 51 by rotation of the pair of rotary arms 58.

The shutter assembly 55 is biased by a spring 59 serving as a biasing member provided to one of the pivots 58*a* on one of the arms 58, such that the shutter 56 closes the entrance 51*a* of the waste toner container 51. In addition, one of the pair of rotary arms 58 has a protrusion 58*b* integrally formed with the arm 58 and extending from an end thereof where the pivot 58*a* is provided. A contact part of the unit housing 10, not shown, contacts the protrusion 58*b* upon attachment of the sub-unit 80 to the unit housing 10 so that the protrusion 58*b* is pressed downward against the biasing force of the spring 59. Accordingly, the shutter assembly 55 is rotated and the shutter 56 opens the entrance 51*a* as illustrated in FIG. 7B.

It is to be noted that, in the example shown in FIGS. 7A, 7B, and 8, the sub-unit 80 is attached to and detached from the unit housing 10 along the longitudinal direction of the sub-unit 80, that is, a direction passing thorough the plane of the sheet of paper on which FIGS. 7A and 7B are drawn. Further, the contact part that presses the protrusion 58*b* downward is formed of a downward tilting guide rail or the like tilting downward along the direction of attachment/detachment of the sub-unit 80.

By contrast, the contact part does not press the protrusion 58*b* downward when the sub-unit 80 is detached from the unit housing 10. Accordingly, the shutter assembly 55 is rotated by the biasing force from the spring 59 so that the shutter 56 closes the entrance 51*a* of the waste toner container 51 as illustrated in FIG. 7A.

Figure 9A:
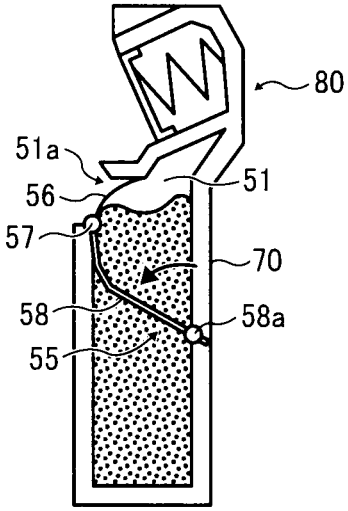
FIGS. 9A and 9B are vertical cross-sectional views respectively illustrating another example of a configuration of the sub-unit.
Figure 9B:
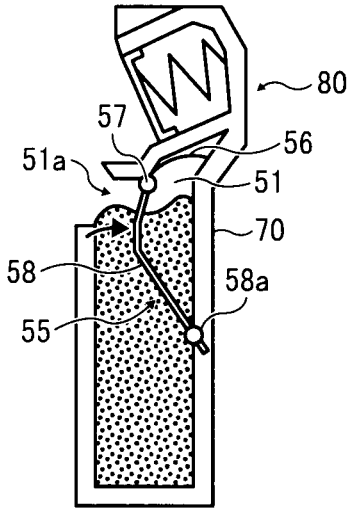

FIGS. 9A and 9B are vertical cross-sectional views respectively illustrating another example of a configuration of the sub-unit 80. In the example illustrated in FIGS. 9A and 9B, the sub-unit 80 is attached to and detached from the unit housing 10 in a direction perpendicular to the longitudinal direction of the sub-unit 80, that is, a horizontal direction in FIGS. 9A and 9B.

The configuration of the shutter assembly 55 shown in FIGS. 9A and 9B is basically the same as that of the shutter assembly 55 shown in FIGS. 7A, 7B, and 8, except that the shutter assembly 55 does not include the protrusion 58*b* and the pair of rotary arms 58 is bent. The contact part of the unit housing 10 contacts the pair of bent rotary arms 58 when the sub-unit 80 is attached to the unit housing 10, thereby rotating the shutter assembly 55 to open the entrance 51*a* of the waste toner container 51 as illustrated in FIG. 9B.

Figure 10A:
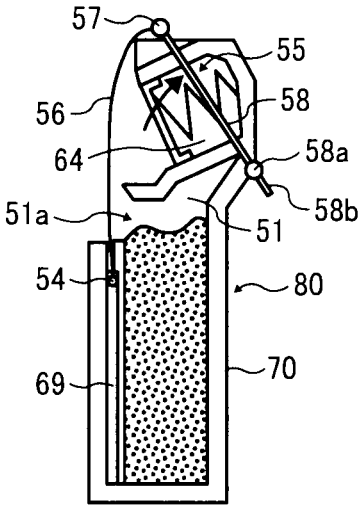
FIGS. 10A and 10B are vertical cross-sectional views respectively illustrating yet another example of a configuration of the sub-unit.
Figure 10B:
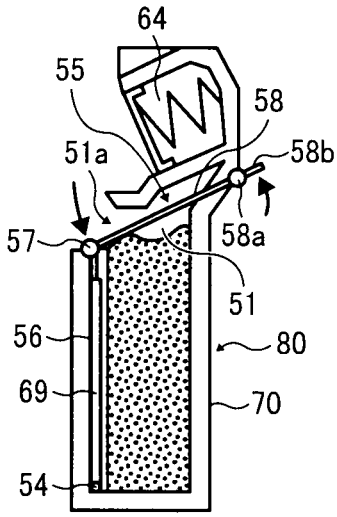
Figure 11:
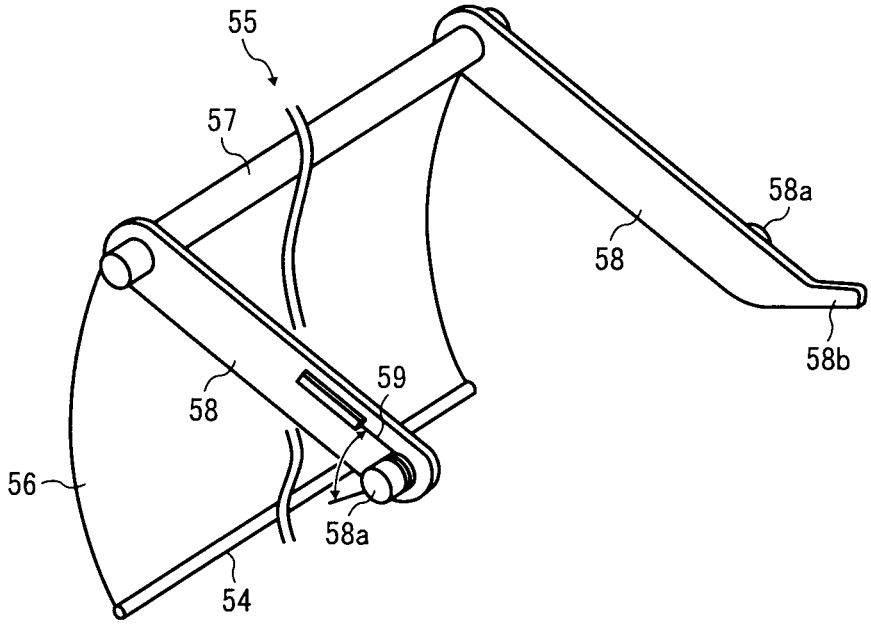
FIG. 11 is a perspective view illustrating an example of a configuration of the shutter assembly included in the sub-unit illustrated in FIGS. 10A and 10B.

FIGS. 10A and 10B are vertical cross-sectional views respectively illustrating yet another example of a configuration of the sub-unit 80. FIG. 11 is a perspective view illustrating an example of a configuration of the shutter assembly 55 included in the sub-unit 80 illustrated in FIGS. 10A and 10B.

Unlike the shutter assembly 55 of the preceding examples, the shutter 56 of the shutter assembly 55 shown in FIGS. 10A, 10B and 11 is formed of a flexible film, and a shutter storage 69 that accommodates the shutter 56 when the shutter assembly 55 is rotated to open the entrance 51*a* of the waste toner container 51 as illustrated in FIG. 10B is provided to the housing 70 of the sub-unit 80. Further, a stopper 54 is provided at an edge of the shutter 56 in order to prevent the edge of the shutter 56 from slipping out of the shutter storage 69 when the shutter assembly 55 is rotated to close the entrance 51*a* of the waste toner container as illustrated in FIG. 10A. The shutter storage 69 narrows at an opening thereof so that the stopper 54, although movable within the shutter storage 69, does not slip out from the opening in the shutter storage 69 but remains therewithin. The rest of the configuration of the shutter assembly 55 illustrated in FIGS. 10A, 10B, and 11 is the same as that of the shutter assembly 55 illustrated in FIGS. 7A, 7B, and 8.

When the sub-unit 80 is detached from the unit housing 10, the shutter assembly 55 is rotated by the biasing force of the spring 59 to lift the shutter 56 so that both of the entrance 51*a* of the waste toner container 51 and an opening in the lubricant container 64 are closed as illustrated in FIG. 10A. By contrast, when the sub-unit 80 is moved in the longitudinal direction thereof, that is, a direction passing through the plane of the sheet of paper on which FIGS. 10A and 10B are drawn, to be attached to the unit housing 10, the contact part of the unit housing 10 contacts the protrusion 58*b* to lift the protrusion 58*b* as illustrated in FIG. 10B. Accordingly, the shutter assembly 55 is rotated so that the shutter 56 is lowered to open the entrance 51*a* of the waste toner container 51 and the opening in the lubricant container 64.

Figure 12A:
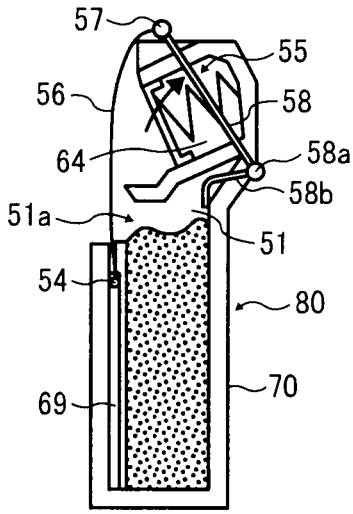
FIGS. 12A and 12B are vertical cross-sectional views respectively illustrating still yet another example of a configuration of the sub-unit.
Figure 12B:
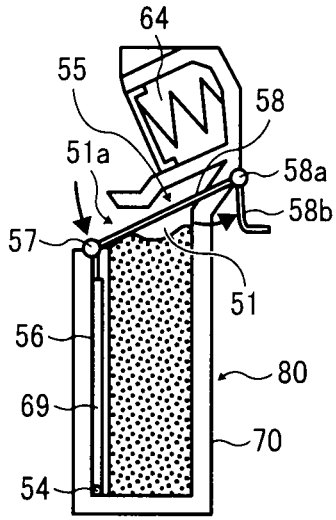

The above-described configuration illustrated in FIGS. 10A, 10B, and 11 is applicable to the sub-unit 80, which is configured to be attached to and detached from the unit housing 10 in a direction perpendicular to the longitudinal direction of the sub-unit 80. FIGS. 12A and 12B illustrate a configuration of such a sub-unit 80.

The configuration of the sub-unit 80 shown in FIGS. 12A and 12B is basically the same as that of the sub-unit 80 shown in FIGS. 10A, 10B, and 11, except that the protrusion 58*b* is L-shaped. When the sub-unit 80 is moved in a direction perpendicular to the longitudinal direction thereof, that is, a horizontal direction in FIGS. 12A and 12B, to be attached to the unit housing 10, the contact part of the unit housing 10 contacts the L-shaped protrusion 58*b* to rotate the protrusion 58*b* in a counterclockwise direction as illustrated in FIG. 12B. As a result, the shutter assembly 55 is rotated so that the shutter 56 is lowered to open the entrance 51*a* of the waste toner container 51 and the opening in the lubricant container 64.

As described above, the sub-unit 80 having the shutter assembly 55 can close the entrance 51*a* of the waste toner container 51 with the shutter 56, thereby preventing spilling and scattering of the waste toner T from the entrance 51*a* of the waste toner container 51 when the sub-unit 80 is detached from the unit housing 10. Alternatively, in place of the shutter assembly 55, a lid that closes the entrance 51*a* of the waste toner container 51 may be attached to the housing 70 of the sub-unit 80 when the sub-unit 80 is detached from the unit housing 10 to prevent spilling and scattering of the waste toner T from the entrance 51*a*. However, because the lid must be attached to the housing 70 of the sub-unit 80 each time the sub-unit 80 is detached from the unit housing 10, provision of the shutter assembly 55 described above can facilitate replacement more than attachment of the lid. In addition, the shutter assembly 55 is rotated to open and close the entrance 51*a* of the waste toner container 51 in conjunction with attachment and detachment of the sub-unit 80 to and from the unit housing 10, thereby further facilitating replacement.

Figure 13:
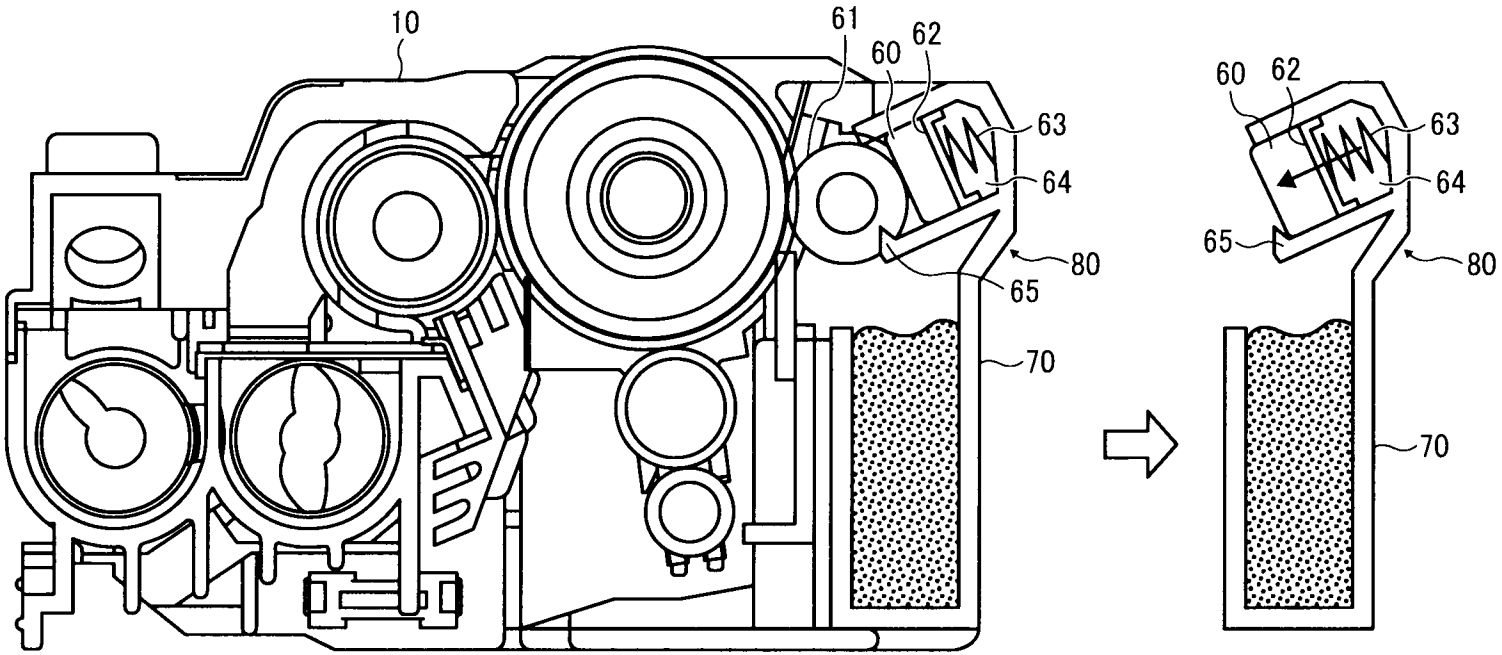
FIG. 13 is a vertical cross-sectional view illustrating still yet another example of a configuration of the sub-unit.

FIG. 13 is a vertical cross-sectional view illustrating still yet another example of a configuration of the sub-unit 80. The sub-unit 80 illustrated in FIG. 13 has a pick-shaped stopper 65 at the opening in the lubricant container 64 to prevent the lubricant 60 from slipping out of the lubricant container 64. Accordingly, even when the lubricant 60 is pressed toward the opening in the lubricant container 64 by the biasing spring 63 upon detachment of the sub-unit 80 from the unit housing 10, the lubricant 60 is prevented from slipping out of the lubricant container 64 by the stopper 65. Further, the stopper 65 is provided in contact with the lubricant application roller 61 also to function as a flicker that removes the waste toner from the lubricant application roller 61.

Upon exhaustion, the lubricant 60 is not supplied to the photoconductor 2 during image formation, of course, thereby possibly degrading cleaning and transfer performance of the photoconductor 2 and causing damage to the photoconductor 2 and the cleaning blade 50. In addition, when the waste toner container 51 is filled up with the waste toner T during image formation, the residual toner removed from the surface of the photoconductor 2 remains within a conveyance path of the residual toner to the waste toner container 51. In a case in which the residual toner remaining within the conveyance path is solidified, the conveyance path may be blocked with such solidified toner. To avoid occurrence of the above-described problems, the sub-unit 80 including the lubricant 60 and the waste toner container 51 needs to be replaced with the new sub-unit 80 before the lubricant 60 is used up and the waste toner container 51 is filled up with the waste toner T. Therefore, it is preferable that a lubricant amount indicator that indicates whether the lubricant 60 is about to run out and a toner amount indicator that indicates whether the waste toner container 51 is about to be filled up with the waste toner T be provided to the sub-unit 80 so that replacement of the sub-unit 80 can be timely instructed based on the indication obtained by the indicators.

Whether the lubricant 60 is about to run out is determined, for example, by prediction based on an accumulated amount of use of the lubricant 60. In turn, the accumulated amount of use of the lubricant 60 can be obtained based on a cumulative number of sheets P on which images have already been formed (hereinafter referred to as printed sheets). Therefore, whether or not the lubricant 60 is about to run out is determined by counting the number of printed sheets.

Whether the waste toner container 51 is about to be filled up with the waste toner T is predicted, for example, based on a calculated amount of the waste toner T stored in the waste toner container 51 or by directly detecting the amount of the waste toner T stored in the waste toner container 51. In the case of the former method, the amount of the waste toner T stored in the waste toner container 51 is calculated based on a cumulative number of pixels of images formed on the printed sheets. In the case of the latter method, for example, detection mechanisms illustrated in FIGS. 14A, 14B, 15A, and 15B may be provided to the waste toner container 51 to determine whether or not the waste toner container 51 is about to be filled up with the waste toner T.

Figure 14A:
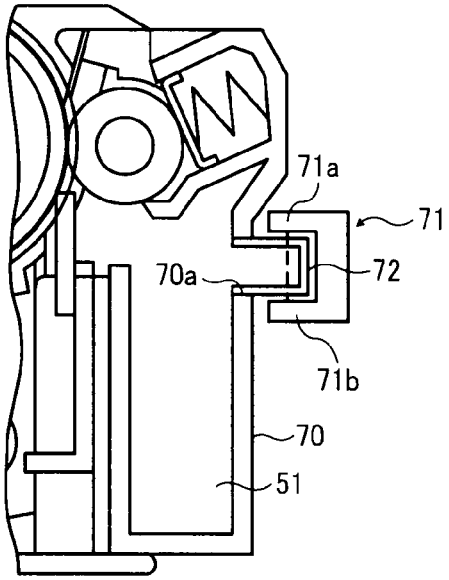
FIGS. 14A and 14B are vertical cross-sectional views respectively illustrating an example of a configuration of a detection mechanism that detects an amount of waste toner stored in a waste toner container.
Figure 14B:
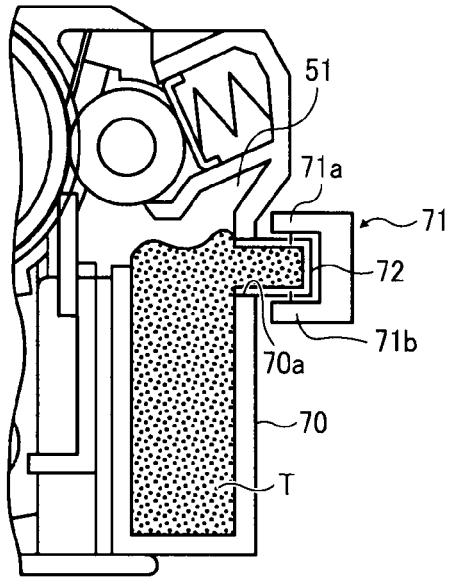

A detection mechanism illustrated in FIGS. 14A and 14B includes a transmissive optical detector 71 having a light emitter 71*a* that emits light and a light receiver 71*b* that receives the light emitted from the light emitter 71*a*. A part of the housing 70 of the sub-unit 80 that forms the waste toner container 51 has a hole 70*a*, and a transparent member 72 through which the light emitted from the light emitter 71*a* passes is fitted to the hole 70*a*. Specifically, the transparent member 72 protrudes outward from the housing 70 to be interposed between the light emitter 71*a* and the light receiver 71*b* of he optical sensor 71.

When the waste toner container 51 is not yet filled up with the waste toner T, the light emitted from the light emitter 71*a* passes through the transparent member 72 and is received by the light receiver 71*b* as illustrated in FIG. 14A. By contrast, when the waste toner container 51 is about to be filled up with the waste toner T, the waste toner T is also stored within the transparent member 72 so that an optical path of the light emitted from the light emitter 71*a* is blocked within the transparent member 72 as illustrated in FIG. 14B. Thus, the optical detector 71 detects blockage of the optical path caused by the waste toner T stored within the transparent member 72 and determines that the waste toner container 51 is about to be filled up with the waste toner T.

Figure 15A:
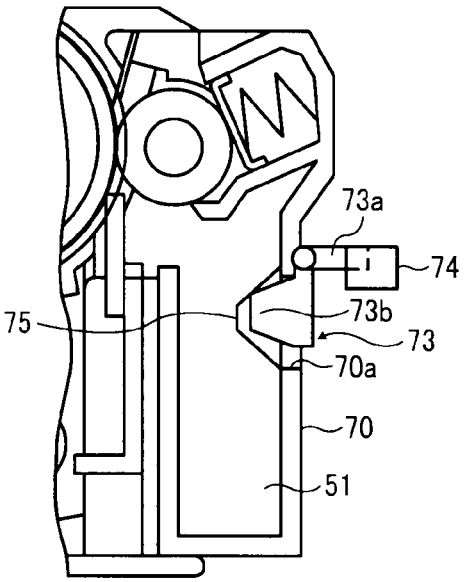
FIGS. 15A and 15B are vertical cross-sectional views respectively illustrating another example of a configuration of a detection mechanism that detects an amount of waste toner stored in a waste toner container.
Figure 15B:
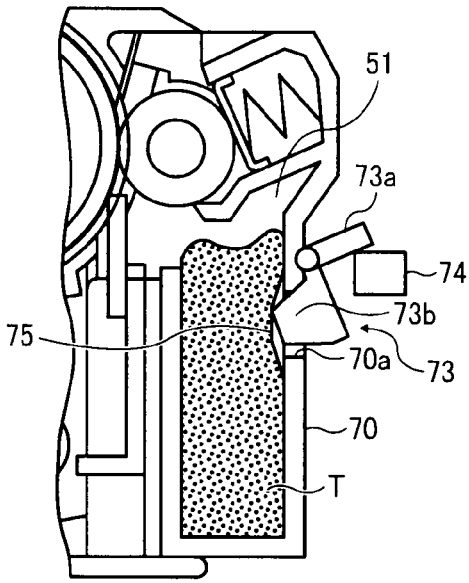

In another approach, a detection mechanism illustrated in FIGS. 15A and 15B includes a detected member 73 rotatably supported by the housing 70, and a transmissive optical detector 74 serving as a detector provided to a frame or the like of the image forming apparatus 100. The housing 70 has the hole 70*a*, and a flexible film member 75 is provided to block the hole 70*a*. The rotatable detected member 73 has a blocking part 73*a* provided between a light emitter and a light receiver of the optical detector 74 to block an optical path of light emitted from the light emitter. The rotatable detected member 73 further has a contact portion 73*b* provided in contact with or close to the film member 75.

When the waste toner container 51 is not yet filled up with the waste toner T, the contact portion 73*b* of the rotatable detected member 73 enters in the hole 70*a* to press the film member 75 inward as illustrated in FIG. 15A. In such a state, the blocking part 73*a* of the detected member 73 is interposed between the light emitter and light receiver of the optical detector 74 to block the optical path. By contrast, when the waste toner container 51 is about to be filled up with the waste toner T, the film member 73 is pushed toward the contact portion 73*b* of the detected member 73 by the waste toner T stored in the waste toner container 51 so that the contact portion 73*b* is pressed by the film member 75 to rotate the detected member 73 as illustrated in FIG. 15B. As a result, the blocking part 73*a* is retreated from a position to block the optical path so that the light emitted from the light emitter enters the light receiver. Thus, the optical detector 74 detects rotation of the detected member 73 caused by the film member 75 pushed by the waste toner T to determine that the waste toner container 51 is about to be filled up with the waste toner T. It is to be noted that, alternatively, the blocking part 73*b* may block the optical path when the waste toner container 51 is about to be filled up with the waste toner T.

As described above, whether the lubricant 60 is about to run out and the waste toner container 51 is about to be filled up with the waste toner T can be timely determined to replace the sub-unit 80 with the new sub-unit 80 before the lubricant 60 is used up and the waste toner container 51 is filled up with the waste toner T, thereby preventing occurrence of the previously described problems. In particular, when the above-described determination is performed by prediction based on the cumulative number of printed sheets or the cumulative number of pixels of images formed on the printed sheets, mechanical components such as detectors are not needed, thereby facilitating determination processes, reducing a number of components and production costs, and making the image forming apparatus 100 more compact. By contrast, in a case in which the detection mechanisms illustrated in FIGS. 14A, 14B, 15A, and 15B are used to directly detect the amount of the waste toner T stored in the waste toner container 51, more accurate determination can be achieved.

Figure 16:
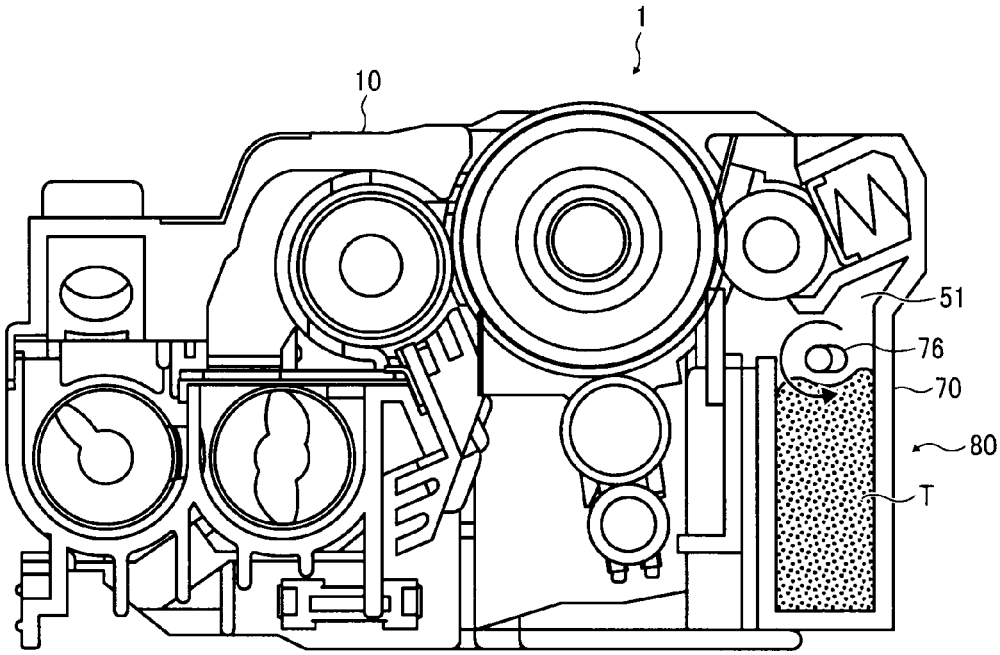
FIG. 16 is a vertical cross-sectional view illustrating an example of a configuration of a leveling member provided to the waste toner container.
Figure 17:
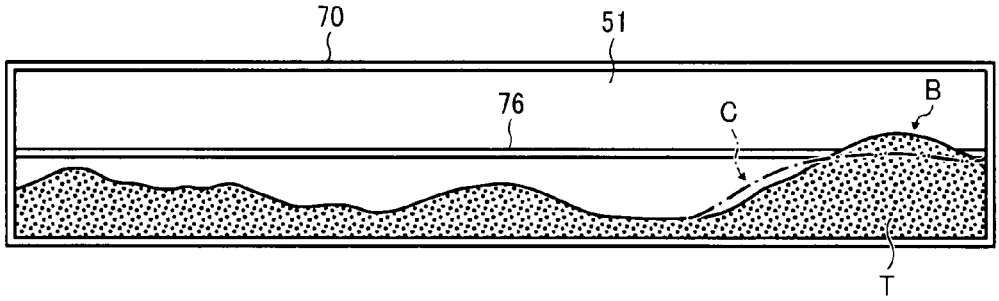
FIG. 17 is an enlarged vertical cross-sectional view illustrating operations of the leveling member illustrated in FIG. 16.

Because the waste toner T is highly coagulated and lacks fluidity, determination that the waste toner container 51 is about to be filled up with the waste toner T may be made before the waste toner container 51 is actually about to be filled up with the waste toner T when the waste toner T is accumulated unevenly in the waste toner container 51. To solve the above-described problem, it is preferable that a leveling member 76 that levels the waste toner T stored in the waste toner container 51 be provided as illustrated in FIG. 16. The leveling member 76 is rotatable by a drive force from a drive source, not shown, and rotation of the leveling member 76 evenly levels a height of the waste toner T in the waste toner container 51. For example, when a part of the waste toner T stored in the waste toner container 51 is accumulated at a height B above the leveling member 76 as illustrated in FIG. 17, the leveling member 76 is rotated to break apart the waste toner T accumulated at the height B and to move the waste toner T to a height C below the leveling member 76. As a result, the height of the waste toner T in the waste toner container 51 is leveled, thereby enabling precise determination of whether or not the waste toner container 51 is about to be filled up with the waste toner T. In addition, a space of the waste toner container 51 can be effectively used, thereby efficiently storing the waste toner T in the waste toner container 51.

Figure 18:
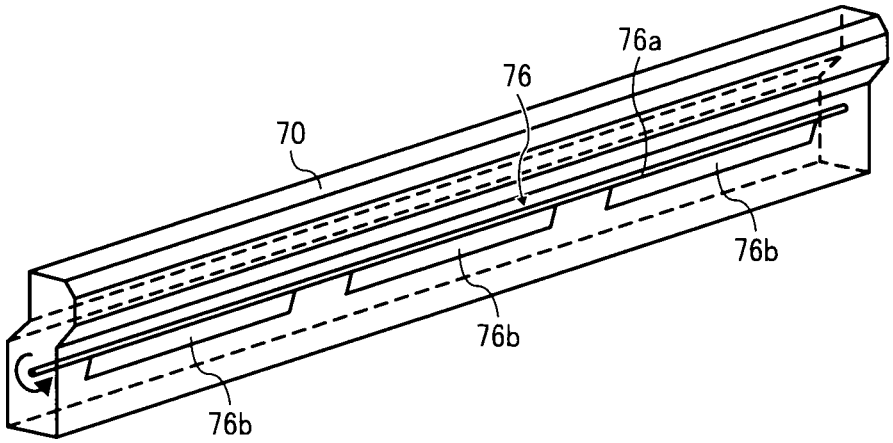
FIG. 18 is a perspective view illustrating another example of a configuration of a leveling member provided to the waste toner container.
Figure 19:
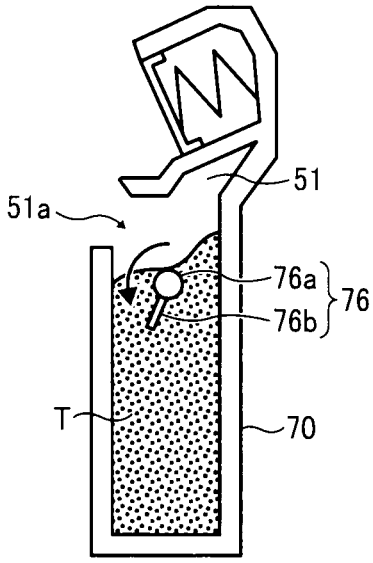
FIG. 19 is a vertical cross-sectional view illustrating the configuration of the leveling member illustrated in FIG. 18.

FIG. 18 is a perspective view illustrating another example of a configuration of the leveling member 76. FIG. 19 is a vertical cross-sectional view illustrating the configuration of the leveling member 76 illustrated in FIG. 18.

The leveling member 76 illustrated in FIGS. 18 and 19 is composed of a rotary shaft 76*a* and blades 76*b* provided to and projecting outward from the rotary shaft 76*a* along an axial direction of the rotary shaft 76*a*. It should be noted that the shape, size, and number of the blades 76*b* are not limited. The leveling member 76 is rotated in a counterclockwise direction in FIG. 19 to move the waste toner T that tends to be accumulated near the entrance 51*a* of the waste toner container 51 distal to the entrance 51*a* using the blades 76*b*. A larger amount of the waste toner T can be moved by the leveling member 76 having the blades 76*b* compared to the leveling member 76 illustrated in FIG. 16. Accordingly, the waste toner T can be more efficiently stored in the waste toner container 51, thereby further enabling whether the waste toner container 51 is filled up with the waste toner T to be accurately determined.

The leveling member 76 may be driven, for example, by a single motor, not shown, or by a drive force transmitted from a gear coupled to a motor that applies a drive force to the photoconductors 2. However, the method for driving the leveling member 76 is not limited to the above-described examples. It is to be noted that, in a case in which the leveling member 76 is driven by the single motor, a rotary torque of the leveling member 76 may be detected to determine whether the waste toner container 51 is about to be filled up with the waste toner T so that the sub-unit 80 is timely replaced with the new sub-unit 80.

Figure 20A:
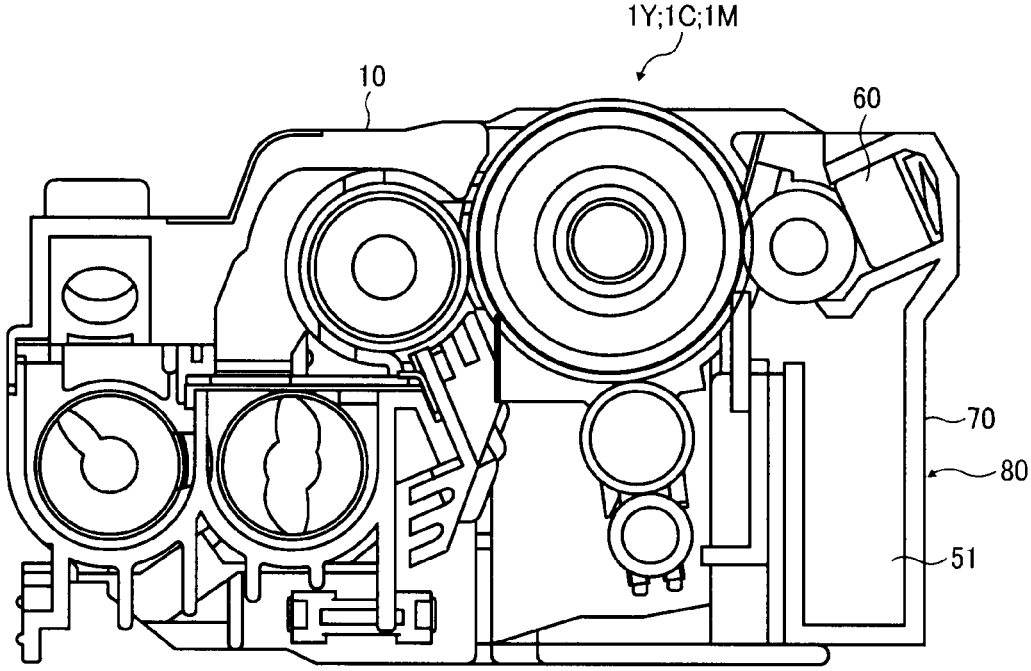
FIGS. 20A and 20B are vertical cross-sectional views respectively illustrating differences in sizes of a lubricant and the waste toner container depending on a frequency in use of the process units.
Figure 20B:
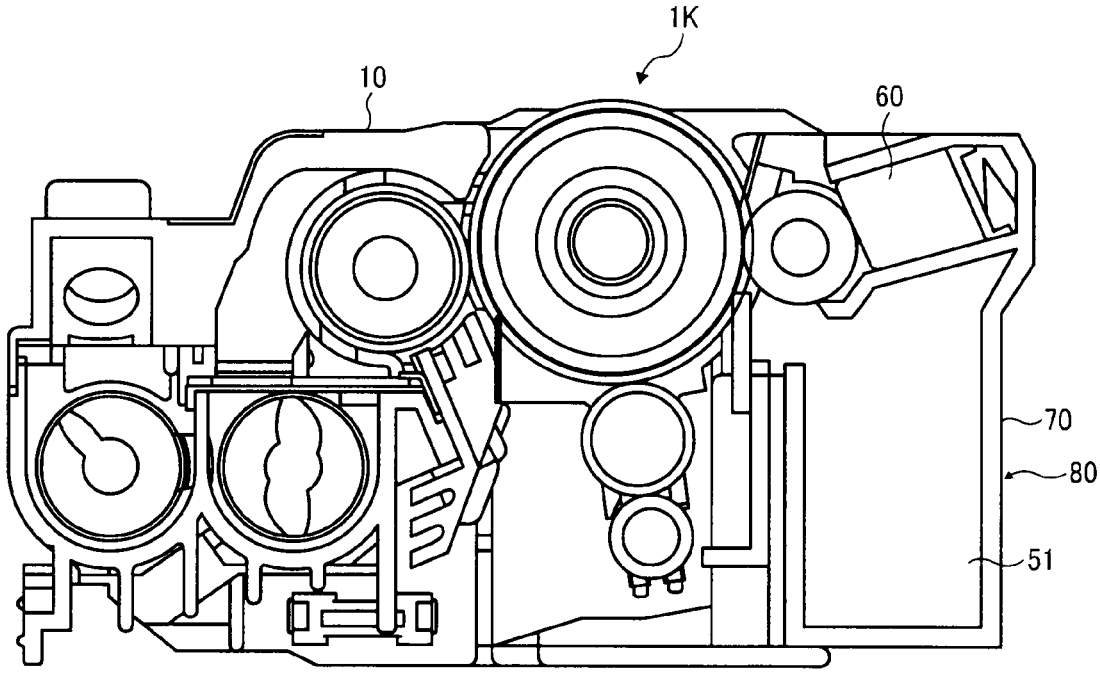

In a full-color image forming apparatus such as the image forming apparatus 100, monochrome images may be more often formed than full-color images. In such a case, an amount of consumption of the lubricant 60 in the process unit 1K may be larger than that of the lubricant 60 in the process unit 1Y, 1C, or 1M. Similarly, the amount of the waste toner T stored in the waste toner container 51 in the process unit 1K may be larger than that of the waste toner T stored in the waste toner container 51 in the process unit 1Y, 1C, or 1M. Consequently, replacement of the sub-unit 80 in the process unit 1K may be more often needed, thereby differing a cycle of replacement of the sub-unit 80 in the process unit 1K from that in the other process units 1Y, 1C, and 1M. Therefore, as illustrated in FIGS. 20A and 20B, an amount of the lubricant 60 and a size of the waste toner container 51 in the process unit 1K, which is the most often used, are set larger than those in the process units 1Y, 1C, and 1M so that replacement of the sub-unit 80 in the process units 1 can be performed all at once. Thus, the amount of the lubricant 60 and the size of the waste toner container 51 differ in each of the process units 1 depending on a frequency of use of the process units 1 in order to match the cycle of replacement of the sub-unit 80 in each of the process units 1, thereby improving work efficiency upon replacement.

As described above, the lubricant 60 and the waste toner container 51 can be replaced simultaneously, thereby improving work efficiency upon replacement. In addition, the lubricant 60 and the waste toner container 51, the cycle of replacement of both of which is shorter than that of the other components, are detachably attachable to the unit housing 10 of the process unit 1 so that the other components such as the photoconductor 2, the charger 3, the developing device 4, and the cleaning device 5 can be effectively used until the end of their product lives. Accordingly, the process unit 1 can be continuously used until the end of its product life and unnecessary waste of resources can be prevented, resulting in resource saving and a reduction in production costs. Further, in the foregoing illustrative embodiments, the lubricant application roller 61 remains used in the unit housing 10 without replacement even when the sub-unit 80 is replaced with the new sub-unit 80. Thus, the lubricant application roller 61 can be effectively used until the end of its product life.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

It is to be noted that, not only the full-color image forming apparatuses but also monochrome image forming apparatuses, copiers, printers, facsimile machines, and multifunction devices having two or more of copying, printing, and facsimile functions, may be used as the image forming apparatus 100.

What is claimed is:

1. A process unit comprising:

a first housing detachably attachable to an image forming apparatus;

an image carrier to carry an image on a surface thereof;

a charger to charge the surface of the image carrier;

a developing device to form the image on the surface of the image carrier;

a cleaning device to remove toner from the surface of the image carrier;

a lubricant to be supplied to the surface of the image carrier;

a lubricant container to contain the lubricant; and a waste toner container having an enclosed space with an opening through a side thereof to store the toner removed from the surface of the image carrier until the space is filled, wherein the first housing includes the image carrier and at least one of the charger, the developing device, and the cleaning device, wherein the lubricant, the lubricant container, and the waste toner container together are detachably attachable to the first housing, and wherein the lubricant and the waste toner container together are detachably attachable to the first housing in a state in which the first housing remains attached to the image forming apparatus.

2. The process unit according to claim 1, wherein a direction in which the lubricant and the waste toner container together are attached to and detached from the first housing is the same as a direction in which the first housing is attached to and detached from the image forming apparatus.

3. The process unit according to claim 1, wherein the first housing further comprises a lubricant supplier to supply the lubricant to the surface of the image carrier, the lubricant supplier remaining present in the first housing when the lubricant and the waste toner container together are attached to and detached from the first housing.

4. The process unit according to claim 1, further comprising:

a second housing to house the lubricant and the waste toner container; and a lid member attached to the second housing, wherein the lid member covers the opening in the waste toner container.

5. The process unit according to claim 1, further comprising:

a second housing to house the lubricant and the waste toner container; and a shutter assembly to open and close the opening in the waste toner container.

6. The process unit according to claim 5, wherein the shutter assembly opens and closes the opening in the waste toner container in conjunction with attachment and detachment of the lubricant and the waste toner container to and from the first housing.

7. The process unit according to claim 1, further comprising a lubricant amount indicator to indicate that the lubricant is about to run out.

8. The process unit according to claim 7, wherein the lubricant amount indicator indicates that the lubricant is about to run out based on a cumulative amount of the lubricant used previously.

9. The process unit according to claim 1, further comprising a toner amount indicator to indicate that the waste toner container is about to be filled up.

10. The process unit according to claim 9, wherein the toner amount indicator indicates that the waste toner container is about to be filled up based on a calculated amount of toner contained in the waste toner container.

11. The process unit according to claim 9, wherein the toner amount indicator indicates that the waste toner container is about to be filled up based on a detected amount of toner contained in the waste toner container.

12. The process unit according to claim 11, further comprising:

a light emitter to emit light;

a light receiver to receive the light emitted from the light emitter; and a transparent portion of the waste toner container, provided between the light emitter and the light receiver, wherein an optical path of the light passing through the transparent portion is blocked by the waste toner contained in the waste toner container in a state in which the transparent portion of the waste toner container is at least partially filled with the waste toner, indicating that the waste toner container is about to be filled up.

13. The process unit according to claim 11, wherein the waste toner container further comprises:

a flexible film member;

a movable detected member provided in contact with or in proximity to the film member; and a detector to detect movement of the detected member, wherein the detected member is moved by the film member when the waste toner stored in the waste toner container pushes the film member toward the detected member, indicating that the waste toner container is about to be filled up.

14. The process unit according to claim 1, wherein the waste toner container comprises a leveling member to level the toner stored in the waste toner container.

15. The process unit according to claim 14, wherein the leveling member comprises a rotary shaft and an outwardly projecting blade provided on the rotary shaft along an axial direction of the rotary shaft.

16. The process unit according to claim 1, further comprising a stopper provided to the lubricant container.

17. The process unit according to claim 1, wherein the lubricant is zinc stearate.

18. An image forming apparatus comprising:

a process unit, the process unit including:

a first housing detachably attachable to the image forming apparatus;

an image carrier to carry an image on a surface thereof;

a charger to charge the surface of the image carrier;

a developing device to form the image on the surface of the image carrier;

a cleaning device to remove toner from the surface of the image carrier;

a lubricant to be supplied to the surface of the image carrier;

a lubricant container to contain the lubricant; and a waste toner container having an enclosed space with an opening through a side thereof to store the toner removed from the surface of the image carrier until the space is filled, wherein the first housing includes the image carrier and at least one of the charger, the developing device, and the cleaning device, wherein the lubricant, the lubricant container, and the waste toner container together are detachably attachable to the first housing, and wherein the lubricant and the waste toner container together are detachably attachable to the first housing in a state in which the first housing remains attached to the image forming apparatus.

19. The image forming apparatus according to claim 18, comprising multiple process units, wherein an amount of the lubricant and a size of the waste toner container in each of the multiple process units differ depending on the process unit.

* * * * *